US009487921B2

(12) United States Patent
Clasen et al.

(10) Patent No.: US 9,487,921 B2
(45) Date of Patent: Nov. 8, 2016

(54) UNDERCUTTER SELF ADJUSTING AND SHOCK ABSORBING DEVICE

(71) Applicant: Dymax, Inc., Wamego, KS (US)

(72) Inventors: Dennis Clasen, Wamego, KS (US); Harold Fechter, Bellevue, KS (US)

(73) Assignee: DYMAX, INC., Wamego, KS (US)

( * ) Notice: Subject to any disclaimer, the term of this patent is extended or adjusted under 35 U.S.C. 154(b) by 0 days.

(21) Appl. No.: 13/694,719

(22) Filed: Dec. 27, 2012

(65) Prior Publication Data

US 2013/0192095 A1 Aug. 1, 2013

Related U.S. Application Data

(60) Provisional application No. 61/631,201, filed on Dec. 29, 2011.

(51) Int. Cl.
*E01B 27/04* (2006.01)

(52) U.S. Cl.
CPC ..... *E01B 27/04* (2013.01)

(58) Field of Classification Search
USPC ..... 299/65; 37/302, 104–107, 94, 97; 172/41; 171/16; 104/7.3, 3.9; 30/385
See application file for complete search history.

(56) References Cited

U.S. PATENT DOCUMENTS

| | | | | | |
|---|---|---|---|---|---|
| 2,532,981 | A * | 12/1950 | Wolfe | 30/385 |
| 2,714,262 | A * | 8/1955 | Malzahn | 37/363 |
| 2,888,757 | A * | 6/1959 | Sheen | 37/352 |
| 3,028,693 | A * | 4/1962 | Malzahn | 37/363 |
| 3,315,384 | A * | 4/1967 | Weyers | 37/352 |
| 3,754,341 | A * | 8/1973 | Caldwell et al. | 37/352 |
| 3,967,396 | A | 7/1976 | Maisonneuve | |
| 4,355,687 | A | 10/1982 | Theurer | |
| 4,429,477 | A * | 2/1984 | Tice et al. | 37/363 |
| 4,563,826 | A | 1/1986 | Whitaker | |
| 5,271,166 | A | 12/1993 | Theurer | |
| 6,658,768 | B1 * | 12/2003 | Bainter | 37/352 |
| 7,185,437 | B2 * | 3/2007 | Behbahany | 30/386 |
| 7,481,168 | B2 * | 1/2009 | Pike et al. | 104/9 |
| 2004/0128869 | A1 * | 7/2004 | Bainter | 37/352 |
| 2005/0155257 | A1 * | 7/2005 | Pike et al. | 37/104 |
| 2011/0083346 | A1 * | 4/2011 | Clasen et al. | 37/104 |

* cited by examiner

*Primary Examiner* — Matthew D Troutman
(74) *Attorney, Agent, or Firm* — Bruce J. Clark

(57) ABSTRACT

A self adjusting chain mechanism for use with an undercutter attached to an excavator having hydraulic means for adjusting the undercutter; the self adjusting mechanism has a chain and sprocket assembly in a sprocket holding frame, a ram and piston, all operating in conjunction with the hydraulics of the excavator with a control system to move an adjuster shaft connected to the chain sprocket assembly, so as to cause the chain to tighten in response to the changes in hydraulic pressure.

11 Claims, 3 Drawing Sheets

UNDERCUTTER SELF ADJUSTING AND SHOCK ABSORBING DEVICE

This Application claims the benefit of prior provisional application No. 61/631,201 filed Dec. 29, 2011.

BACKGROUND OF THE INVENTION

This invention relates to the field of undercutters. Undercutters are used to scoop out contaminated gravel from beneath railroad tracks. These devices employ a chain mechanism pulled by drive means around an elongated bar in a manner similar to that of a chain saw. An undercutter however utilizes a much larger chain and cutting mechanism, and exists in an extremely abrasive environment. Thus, by its nature the chain is extremely heavy, several hundred pounds, requiring two or more men to lift and remove it to gain access to the bar for replacement or adjustment, and difficult to do in the field without lifting equipment.

Adjustment of the chain is necessary after periods of use due to stretching of the chain, or other reasons that cause the chain to loosen. Consequently, work must be stopped, hand tools are then used to access the adjusting screws near the tip of the bar to extend the bar so as to tighten the chain against it. This is time consuming and results in lost labor hours, and lost productivity of the undercutter when not in use. It is estimated that at least twenty minutes is lost every two hours or so as a result of stopping and adjusting. Furthermore, operators must keep chain tension in mind in addition to the many other operational and safety issues of which they must be aware. The chain can go slack by taking too big of a bite, causing extra stops to adjust. Thus one object of the invention is to provide an automatic chain adjusting mechanism, that not only will avoid the otherwise lost labor involved, but will also provide the adjusting while in use, and without work stoppage so as to avoid downtime of the undercutter.

Consistent tension is also a problem. When hand tightening, the resulting chain tension is often inconsistent and not at the optimum tension. The chain wears best, and lasts longest, with the proper tension, and hand tightening doesn't always allow for the correct tension. Moreover, and just as significant, during use the chain tension itself loosens gradually. Thus the chain is seen to have a substantial amount of use under less than optimum chain tension. Until the chain is tightened back to the optimum tension, continued use of the undercutter creates unnecessary wear and tear on the slack chain. Moreover, loose chains are more likely to have debris caught in them, or to break, creating safety hazards. Thus an object of the invention is to also provide for a chain adjusting mechanism that adjusts essentially continuously so as to provide a constant desired chain tension during use A safety hazard, as well as unnecessary wear and tear, can occur when the chain suffers sudden shocks and stresses during use. In the harsh environment in which an undercutter is used, such hazards are not uncommon. A shock absorbing mechanism is needed to avoid stresses from such shocks, thus it is a further object to provide such a shock absorbing mechanism.

It is a further object of the invention to provide a self adjusting chain mechanism that utilizes existing hydraulic means used in connection with the undercutter itself, and even to work in conjunction with the hydraulics of the excavator to which the undercutter is attached.

No known devices provide these features in the heavy duty undercutter environment.

Other features and objects will be apparent from the disclosure herein.

DESCRIPTION OF THE PREFERRED EMBODIMENTS

Figure 3:
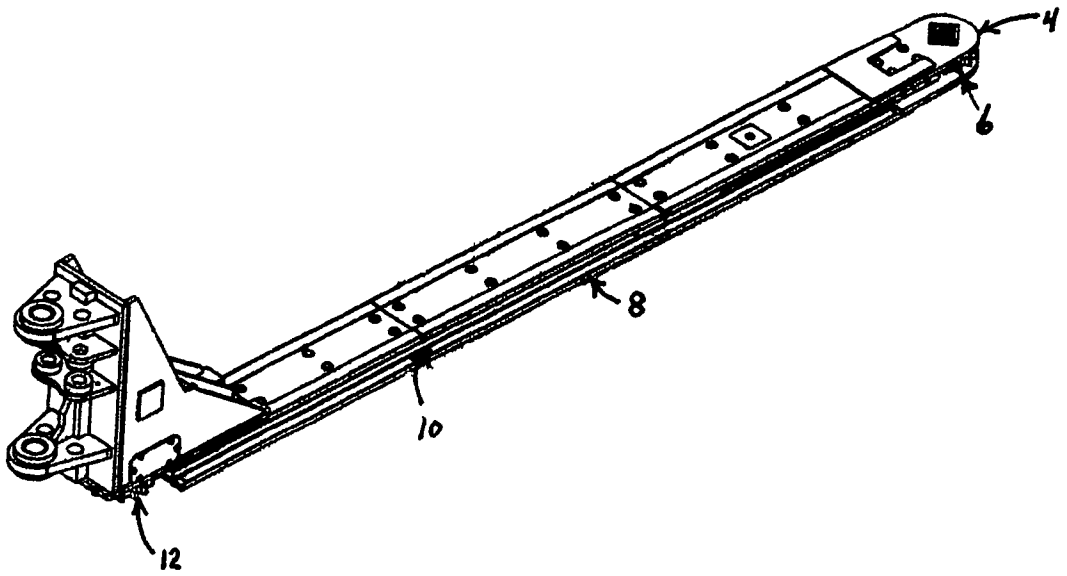
FIG. 3 shows the undercutter with which the invention is used, with sprockets for guiding the chain.

The undercutter with which the invention is used is shown in FIG. 3, and has chain sprocket 6 at the distal end 4. The chain moves about the sprocket and the bar 8 riding in channel 10. The chain is moved by motor and opposite sprocket at 12. The chain is thus tensioned appropriately between the two sprockets, and in general, the invention accomplishes this by adjusting the distal sprocket 6. The invention, with ram, piston and other parts discussed hereafter, reside in the interior of the bar 8 in FIG. 3.

Figure 1:
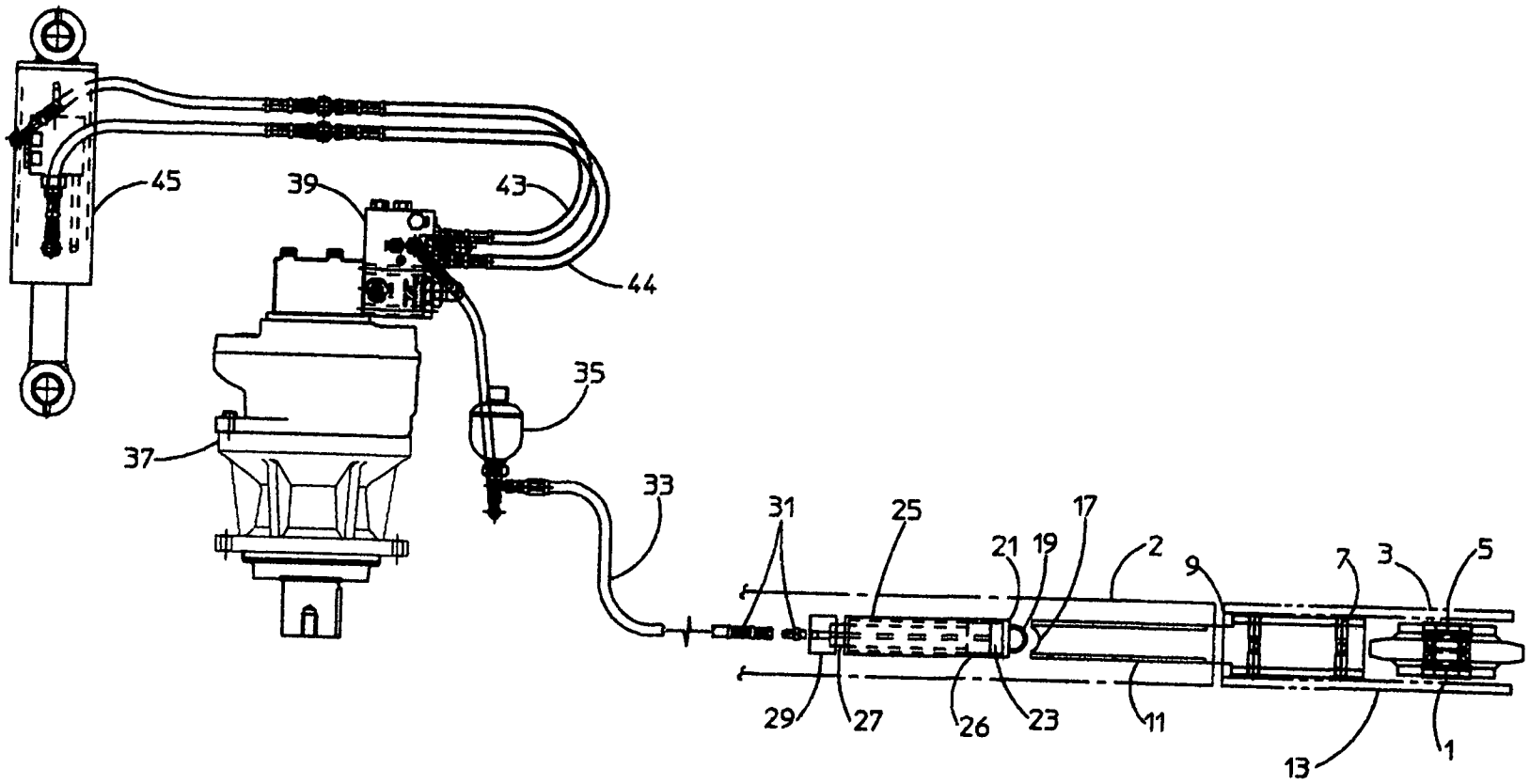
FIG. 1 is a side view of the invention showing the hydraulic arrangement in the preferred mode.

Referring now in more detail to FIG. 1, the sprocket 1 is fixed in chain sprocket frame 3 (also referred to as sprocket frame or sprocket frame assembly). The sprocket frame has pin means or bolt means 5 about which the sprocket rotates. Consequently, the frame is moveable as part of the undercutter design, so as to allow the sprocket to move forward or backwards to tighten or loosen the chain. The adjuster shaft 11 is attached to the sprocket frame, and in the preferred mode this is accomplished through pin means 7 and 9, or other means to secure, releasably or otherwise, the adjuster shaft to the sprocket assembly. Pin means also includes bolts or otherwise means acting as a pin.

Ram means 25 is part of a hydraulic piston assembly which ram means are responsive to hydraulic pressure provided by hydraulic connections at 31. In particular, push block 29 is stationary in the bar 2 and also affixed to the piston rod 27 which is connected to the piston 26 such that the ram 25 is displaced forward toward the distal end referred to in FIG. 3, in response to hydraulic fluid filling the ram barrel 23. Consequently, when the ram barrel 23 fills with hydraulic fluid at 23, the fluid provides force against the piston 26 which drives the ram. Piston head 19, affixed to the piston, is curved in the preferred mode so as to minimize side loads that may occur, drives a corresponding curved end 17 of the adjustor shaft 11, thus driving the adjuster shaft and the sprocket assembly towards the distal end of the entire bar. The piston head 19 and the adjuster shaft end 17, are not connected but just adjacent each other in the preferred mode; however, it is envisioned that in alternative modes they may be connected, releasably or otherwise.

The hydraulic system is shown in its basic form having interconnected hoses with standard hydraulic fluid, and in the preferred mode, uses that of the excavators to which the undercutter is attached, which is one of the unique attributes of the invention; however, a self contained hydraulic system used solely for the invention is also envisioned, independent of the excavator system. The hydraulic hose servicing the piston at 31 has accumulator 5 in line so as to allow for relief for sudden pressure changes in the system caused by sudden jarring or other movements of the sprocket that occur during cutting, as such movements will cause sudden pressure increases in the piston and thus the hydraulic system. The accumulator has gaseous means maintained inside for providing the cushion in the preferred mode, however any accumulator or other cushioning means for cushioning sudden increases in hydraulic pressure without blowing other safety or release valves, is intended, including spring or other mechanical means.

The hose to the accumulator 5 is attached to the special manifold means 39, discussed later. The manifold 39 is, in the preferred mode, connected to the chain motor 37 of the undercutter so as to provide, from the excavator hydraulics, the local hydraulic pressure to run the motor while channeling fluid for the invention; however it will be seen later that on startup the preferred mode also uses the hydraulics of the excavator to provide the priming oil and pressure to the ram assembly after the chain is replaced. The excavator provides the hydraulic pressure to the motor, or the alternative is to initialize the startup.

Figure 2:
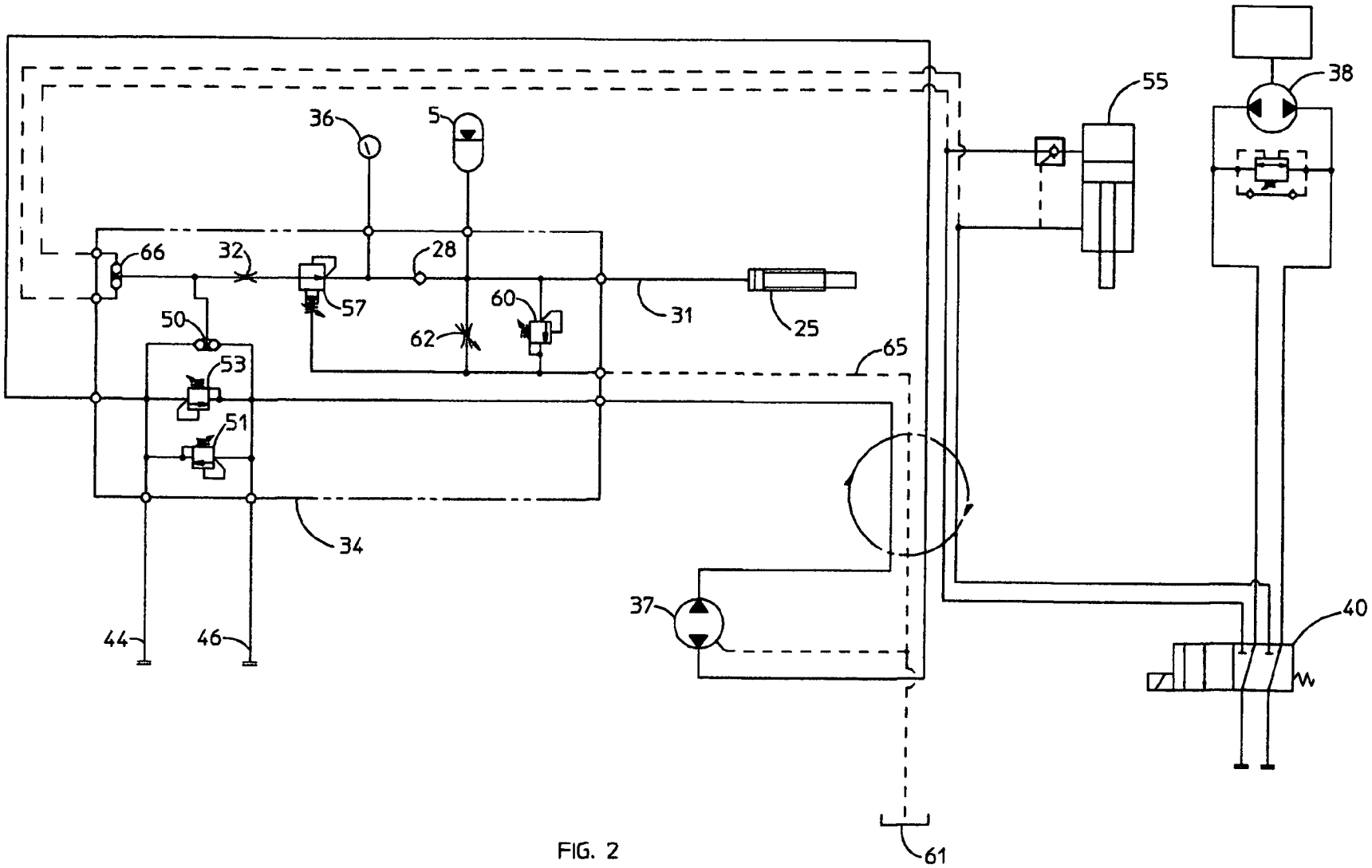
FIG. 2 shows the overall hydraulic system and structure of the invention in combination with the undercutter motor and the hydraulics of the excavator

The manifold means 39 is shown in more detail in FIG. 2. Shuttle valves 51 and 53 feed pressure from either the undercutter motor, or the tilt cylinder 55 that the excavator uses to tilt the undercutter during use, whichever higher pressure is required. Pressure reducing valve 57 provides adjustable pressure means to adjust the running chain tension, which is the desired tension of the chain while in use. In the preferred mode, this pressure is 1600 psi for the system, but this will vary some under the circumstances and particulars of the device, the cutting environment and the operator judgment. Relief valves 70 and 71 provide overload relief for the motor, which is typically set at 4200 psi.

Pressurized hydraulic fluid is sent through the one way check valve 54 to the base end 31 of the ram 25 which ram controls the running tension of the chain.

The accumulator 5 is precharged to 2100 psi. Relief valve 60 protects the circuit from excess pressure above the running and cushion precharge levels, and in the preferred mode is set slightly higher at 2500 psi. Any discharge oil from this valve 60 opening is sent into the case drain line 65 and into the manifold drain 61.

To service the chain, valve 62, a needle valve, is opened while pushing on the end of the bar at the distal end to relieve the pressure. The oil is discharged into the drain line 65.

After servicing or replacing the chain, to initially retension the chain, the tilt cylinder 55 on the excavator is activated in either direction, i.e. the excavator operator moves the undercutter in either direction. This sends pressurized hydraulic fluid through shuttle valve 66 to the circuit, enabling the chain to be tensioned without running the motor. Without this step, and simply starting the chain motor 37 with no pressure in the system to the ram, the chain begins moving before it is properly tensioned, creating jerks in movement that create wear and tear and that create a safety hazard. The chain needs to be tight before it starts running. Other means are envisioned for providing initial pressure to the chain on startup, including the use of an external pump to prime the system, which could be operated by hand. Also, pneumatic means are envisioned not only for priming, which require additional control valves to isolate, but also could be used in lieu of hydraulics for the system.

Thus it can be seen that a self adjusting mechanism for providing constant tension to the chain of an undercutter is provided.

What is claimed is:

1. An undercutter selfadjusting chain mechanism for providing chain tension adjustment during use to keep tension near a desired level, and where the undercutter is attachable to an excavator or other mobile equipment having hydraulic means for moving the attached undercutter, said mechanism comprised of:

a. an undercutter having a rigid elongated bar, said bar having a first end and an opposite distal end, where the said two opposite ends form a longitudinal axis between them;

b. two rotatable sprockets, one a distal end sprocket at the distal end, and a corresponding sprocket at the opposite end of the bar;

c. a continuous chain moving about the bar and guided by the two sprockets;

d. means for allowing the sprocket at the distal end to move longitudinally while rotating;

e. hydraulic force means for moving the distal sprocket in a longitudinal direction automatically during use in response to changes in chain tension.

2. The undercutter self adjusting device in claim 1 where the means for allowing the distal sprocket to move longitudinally is comprised of a sprocket frame slidably attached to the bar at the distal end so as to move the sprocket frame in the longitudinal direction when an external force is applied to it, and where the distal sprocket is rotatably attached to the sprocket frame.

3. The undercutter self adjusting device in claim 1 or 2 wherein the hydraulic force means is provided by the excavator hydraulic means.

4. The undercutter device in claim 1 or 2 having a hydraulic accumulator to attenuate sudden movements in the ram so as to provide shock absorbing action.

5. The undercutter self adjusting device in claim 1 or 2 wherein the means for moving the sprocket in a longitudinal direction is a piston assembly comprised of:

a. a piston fixed with respect to the bar, and said piston having a first end and a second end;

b. a ram that is longitudinally slidable about the piston, having a first end and a second end, wherein the second end is adjacent the sprocket frame;

c. a ram barrel created between the ram and the piston at the second end of the ram;

d. means for providing hydraulic force to the ram barrel so as to cause the ram to force the sprocket frame to slidably move in response to the said hydraulic force means.

6. The undercutter self adjusting device in claim 1 or 2 wherein:

a. the means for moving the sprocket in a longitudinal direction is a piston assembly comprised of a piston fixed with respect to the bar, and said piston having a first end and a second end; a ram that is longitudinally slidable about the piston, having a first end and a second end, wherein the second end is adjacent the sprocket frame; a ram barrel between the ram and the piston at the second end of the ram; means for providing hydraulic force to the ram barrel so as to cause the ram to force the sprocket frame to slidably move in response to the said hydraulic force applied to the ram barrel;

b. wherein the hydraulic force means is provided by the excavator hydraulic means;

c. and further having a hydraulic accumulator to attenuate sudden movements in the ram and provide shock absorbing action.

7. The undercutter self adjusting device in claim 1 where the means for the distal end sprocket to move longitudinally is comprised of a sprocket frame slidably attached to the bar at the distal end so as to move the sprocket frame in the longitudinal direction when an external force is applied to it, and where the distal end sprocket is rotatably attached to the sprocket frame.

8. An undercutter selfadjusting chain mechanism for providing chain tension adjustment during use to keep tension near a desired level, and where the undercutter is attachable to an excavator or other mobile equipment having hydraulic means for moving the attached undercutter, said mechanism comprised of:

a. an undercutter having a rigid elongated bar, said bar having a first end and an opposite distal end, where the said two opposite ends form a longitudinal axis between them;

b. two rotatable sprockets, one a distal end sprocket at the distal end, and a corresponding sprocket at the opposite end of the bar;

c. a continuous chain moving about the bar and guided by the two sprockets;

d. means for allowing the sprocket at the distal end to move longitudinally while rotating;

e. hydraulic force means for moving the distal sprocket in a longitudinal direction automatically during use in response to changes in chain tension;

f. a rigid ram moving in response to said hydraulic force means.

9. The undercutter device in claim 8 having self priming means so as to provide hydraulic fluid to the device in response to the movement of the device itself by the excavator.

10. An undercutter selfadjusting chain mechanism for providing chain tension adjustment during use to keep tension near a desired level, and where the undercutter is attachable to an excavator or other mobile equipment having hydraulic means for moving the attached undercutter, said mechanism comprised of:

a. an undercutter having a rigid elongated bar, said bar having a first end and an opposite distal end, where the said two opposite ends form a longitudinal axis between them;

b. two rotatable sprockets, one a distal end sprocket at the distal end, and a corresponding sprocket at the opposite end of the bar;

c. a continuous chain moving about the bar and guided by the two sprockets;

d. means for allowing the sprocket at the distal end to move longitudinally while rotating;

e. pneumatic force means for moving the distal sprocket in a longitudinal direction automatically during use in response to changes in chain tension.

11. An undercutter selfadjusting chain mechanism for providing chain tension adjustment during use to keep tension near a desired level, and where the undercutter is attachable to an excavator or other mobile equipment having hydraulic means for moving the attached undercutter, said mechanism comprised of:

g. an undercutter having a rigid elongated bar, said bar having a first end and an opposite distal end, where the said two opposite ends form a longitudinal axis between them;

h. two rotatable sprockets, one a distal end sprocket at the distal end, and a corresponding sprocket at the opposite end of the bar;

i. a continuous chain moving about the bar and guided by the two sprockets;

j. means for allowing the sprocket at the distal end to move longitudinally while rotating;

k. pneumatic force means for moving the distal end sprocket in a longitudinal direction automatically during use in response to changes in chain tension;

l. a rigid ram moving in response to said pneumatic force means.

* * * * *